US010398013B2

(12) United States Patent
Camara

(10) Patent No.: US 10,398,013 B2
(45) Date of Patent: Aug. 27, 2019

(54) X-RAY GENERATOR DEVICE WITH IMPROVED FIELD EMISSION

(71) Applicant: Tribogenics, Inc., Los Angeles, CA (US)

(72) Inventor: Carlos Camara, Los Angeles, CA (US)

(73) Assignee: Tribo Labs, Marina Del Rey, CA (US)

( * ) Notice: Subject to any disclaimer, the term of this patent is extended or adjusted under 35 U.S.C. 154(b) by 61 days.

(21) Appl. No.: 15/452,553

(22) Filed: Mar. 7, 2017

(65) Prior Publication Data

US 2017/0257936 A1 Sep. 7, 2017

Related U.S. Application Data

(60) Provisional application No. 62/304,880, filed on Mar. 7, 2016.

(51) Int. Cl.
*H05G 2/00* (2006.01)

(52) U.S. Cl.
CPC ..... *H05G 2/00* (2013.01)

(58) Field of Classification Search
CPC ..... H05G 2/00
See application file for complete search history.

(56) References Cited

U.S. PATENT DOCUMENTS 6,385,292 B1 * 5/2002 Dunham et al. ..... H05G 2/00 378/124
9,008,277 B2 * 4/2015 Camara ..... H05G 2/00 378/140
9,089,038 B2 * 7/2015 Camara et al. ..... A61B 6/032 378/122
9,173,279 B2 * 10/2015 Camara ..... H01J 35/06
9,728,368 B2 * 8/2017 Camara ..... H05G 2/00
9,814,125 B2 * 11/2017 Camara ..... H01J 35/06
9,991,084 B2 * 6/2018 Camara ..... H05G 2/00
2005/0244991 A1 11/2005 Mao et al.
2013/0343526 A1 * 12/2013 Putterman ..... H01J 35/02 378/121
2014/0044235 A1 2/2014 Camara et al.
2014/0270084 A1 9/2014 Camara
2014/0270085 A1 9/2014 Camara et al.
2014/0270088 A1 * 9/2014 Camara ..... H01J 35/06 378/140
2014/0369474 A1 * 12/2014 Nottke ..... H05G 2/00 378/119
2015/0213993 A1 * 7/2015 Camara ..... H05G 2/00 378/140
2016/0029469 A1 * 1/2016 Camara ..... H01J 35/06 378/140
2017/0257936 A1 * 9/2017 Camara ..... H05G 2/00
2018/0068822 A1 * 3/2018 Camara ..... H05G 2/00

OTHER PUBLICATIONS

International Search Report on related PCT Application No. PCT/US2017/021204 from International Searching Authority (KIPO) dated Jul. 3, 2017.
Written Opinion on related PCT Application No. PCT/US2017/021204 from International Searching Authority (KIPO) dated Jul. 3, 2017.

* cited by examiner

*Primary Examiner* — Thomas R Artman
(74) *Attorney, Agent, or Firm* — Klein, O'Neill & Singh, LLP

(57) ABSTRACT

A high energy radiation device may include a band and/or contact rod with surface properties to enhance field emissions or otherwise assist in control of x-ray generation.

11 Claims, 4 Drawing Sheets

X-RAY GENERATOR DEVICE WITH IMPROVED FIELD EMISSION

CROSS REFERENCE TO RELATED APPLICATION

This application claims the benefit of the filing date of U.S. Provisional Patent Application No. 62/304,880, filed on Mar. 7, 2016, the disclosure of which is incorporated by reference herein.

BACKGROUND OF THE INVENTION

The present invention relates generally to generation of high-energy radiation, and more particularly to generation of high energy radiation by mechanical motion.

X-rays are used in a variety of ways. X-rays may be used for medical or other imaging applications, crystallography related applications including material analysis, or in other applications.

X-rays are generally generated by electron braking (bremsstrahlung) or inner shell electron emission within a material. Historically, other than through natural phenomena, x-rays generally have been generated by accelerating electrons into a material, such as a metal, with a small proportion of the electrons causing x-rays through bremsstrahlung or knocking electrons present in the material out of inner orbitals, for example K-shell orbitals, with x-rays being generated as electrons in higher energy orbitals transition to the lower energy orbitals. Acceleration of the electrons to generate a useful quantity of x-rays, however, generally requires expenditure of significant power, particularly when considering the small percentage of such electrons which actually result in x-ray emissions.

X-rays may also be generated by changes in mechanical contact between materials in a controlled environment, for example through the unpeeling of pressure sensitive adhesive tape or mechanical contact of some materials in an evacuated chamber. However, utilization of such methods to provide a sufficient intensity of x-rays to be commercially useful, and doing so outside of a laboratory environment, may be difficult.

BRIEF SUMMARY OF THE INVENTION

A high energy radiation device may include a band and/or contact rod with surface properties to enhance field emissions or otherwise assist in control of x-ray generation.

One aspect of the invention is an x-ray generation device, comprising: a housing for maintaining a low fluid pressure environment; a contact material within the housing; a band including an inner surface and an outer surface, the inner surface in frictional contact with the contact material; and an electron target proximate a location of frictional contact between the band and the contact material; wherein the inner surface of the band includes a textured surface.

These and other aspects of the invention are more fully comprehended upon review of this disclosure.

DETAILED DESCRIPTION

Figure 1:
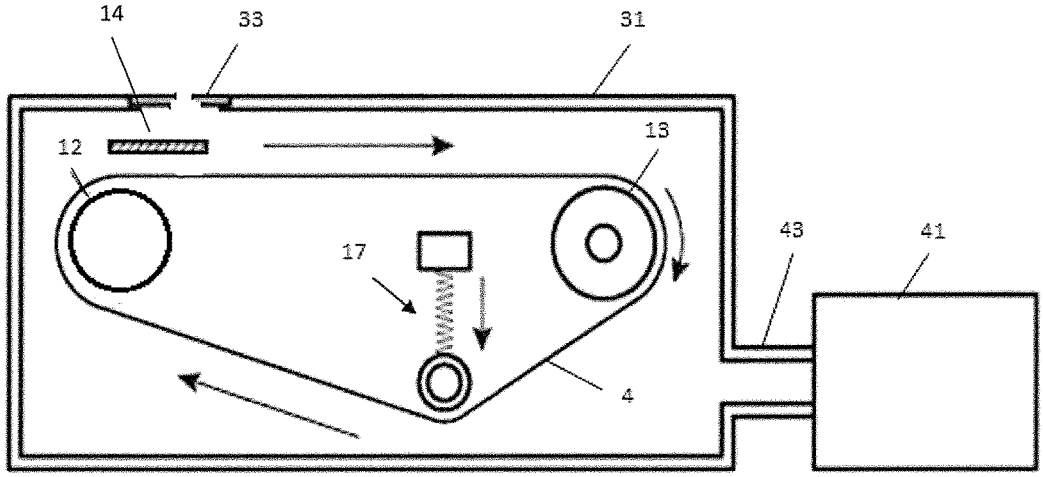
FIG. 1 illustrates a high energy radiation generator device, for example an x-ray generator device, in accordance with aspects of the invention.

FIG. 1 illustrates a high energy radiation generator device, for example an x-ray generator device, in accordance with aspects of the invention. The device includes a band 4 looped around a drive roller 13 and a contact material 12, which may be in the form of a rod, and for convenience may be termed a contact rod herein. In some embodiments, and as shown in FIG. 1, a tensioning device 17 may be used to provide or maintain sufficient tension in the band so as to remain in drivable contact with the drive roller.

The band, contact rod, and, at least as shown in FIG. 1, the drive roller are in a housing 31. The housing provides a low fluid pressure environment, for example less than 100 mTorr, with for example a vacuum pump providing for evacuation of the housing through an orifice 43. In many embodiments, however, in operation the orifice is sealed after the low fluid pressure environment is achieved, and the vacuum pump is removed from the device. In some embodiments the housing includes a getter. In some embodiments, the pressure in the sealed housing is controlled by a getter.

In general, material of the band and material of the surface of the contact rod are selected such that varying contact of areas of surface of the band with the surface of the contact rod results in generation of a charge imbalance when the band is caused to slide against the contact rod, through tribocharging in various embodiments. Preferably the tribocharging results in relative charge accumulation on portions of the band when in varying contact with the surface of the rod, in many embodiments negative charge accumulation, but in some embodiments the relative charge accumulation on the band may be positive charge accumulation.

The band may be a continuous band, as illustrated in FIG. 1, although various embodiments may include bands that are not continuous. In some embodiments the band may be comprised of material that varies within or across the band. In some embodiments the band may comprise a plurality of bands, of which some or all may have varying or the same properties. In some embodiments the band comprises an electrically insulating material. In some embodiments the band comprises a polyimide membrane. In some embodiments the band comprises a Kapton membrane. In some embodiments the band includes an inner surface, which faces inwardly of an area defined by the band and towards the contact rod and drive roller, and an outer surface, facing outward from the area defined by the band, with the outer surface being of a material and/or having a structure providing for controlling electron emission from the band when charged. In some such embodiments the outer surface is of a material and/or structure providing for field emission or increased field emission from the outer surface of the band.

The contact material may be in the form of a rod, or may be in the form of another structure, or may provide a surface of or covering for a rod or other structure. For convenience, generally herein the contact material may be referred to as a contact rod, a rod, or a contact. In some embodiments the surface of the rod comprises an electrically conductive material. In some embodiments the surface of the rod comprises a metal such as silver. In some embodiments the surface of the contact comprises Molybdenum. In some embodiments the rod is a metal rod, and in some embodiments the rod is a Molybdenum or Molybdenum alloy rod. In some embodiments the contact rod might have a coating. In some embodiments the contact rod might have a diamond like carbon coating (DLC). In some embodiments the contact rod may have a further coating over portions of the DLC coating.

The drive roller may be driven by a motor 119, which results in rotation of the band. As the band rotates, the band slides against a surface of the contact rod, generating a charge imbalance as previously mentioned. This charge imbalance allows for accumulation of electrons on the band, which may be released as the band loses contact with the contact rod.

The device also includes an electron target 14. The electron target is, in the embodiment of FIG. 1, outside the area defined by the band, and proximate a location where the band releases from the contact rod. In some embodiments the electron target, or in some embodiments a surface of the electron target, comprises an electrically conductive material. In some embodiments the electron target comprises a thin (~50 micron) low Z material with a 0.5 micron coating of an electrically conductive material. In some embodiments electrically conductive material comprises a metal, which in some embodiments may be a metal such as silver, or a metal alloy. In some embodiments the electrically conductive material comprises Molybdenum or a Molybdenum alloy. As shown in FIG. 1, the electron target is proximate the contact rod, proximate locations of the contact rod at which the band exits contact with the contact rod during rotation of the band. As the band exits contact with the contact rod, the portion of the band exiting such contact discharges excess electrons resulting from negative charge accumulation on the band. Some of these electrons strike the electron target, generating x-rays. The x-rays, or some of them, may exit the housing through a window 33 in the housing. The window may be of beryllium, for example, or some other material generally transparent to x-rays.

Figure 2:
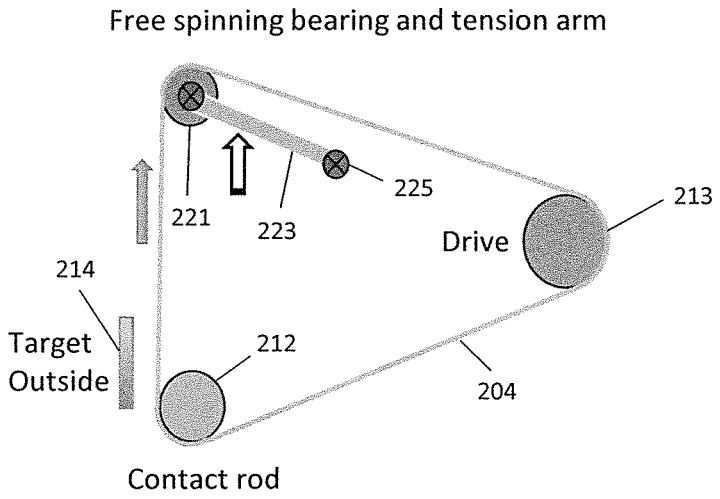
FIG. 2 illustrates portions of a further high energy radiation generator device.

FIG. 2 illustrates portions of a further high energy radiation generator device, for example an x-ray generation device. In FIG. 2, a band 204 is looped around a drive roller 213, a contact rod 212, and a bearing 221 of a tensioner. In the embodiment of FIG. 2, the bearing 221 is at a first end of an arm 223 of the tensioner, with the arm having second end 225 fixed in position. A mechanism (not shown in FIG. 2), is used to move the first end of the arm upward, so as to apply tension to the band. In some embodiments the applied tension is between 0.1 Newtons (N) and 20 N. In some embodiments the drive roller is operable at a speed between 100 revolutions per minute (RPM) and 20,000 RPM, and in some embodiments is controllable, for example by circuitry for controlling a motor driving the drive roller, to operate at a selected speed or speeds within that range, for example to provide control of emissions to the electron target.

An inner surface of the band contacts the drive roller, contact rod, and bearing, while an outer surface faces away from those components. The band and the contact rod may be of materials as discussed with respect to FIG. 1, or elsewhere herein. In most embodiments the portions of the further high energy radiation device will be in a housing providing a low fluid pressure environment, for example less than 100 mTorr.

In operation, the drive roller drives the band around the drive roller, contact rod, and bearing, for example in a clockwise direction in the view of FIG. 2. Any segment of the band, therefore, will pass over the drive roller, and travel towards and contact the contact rod. As the contact rod is generally fixed in position, the segment of the band will frictionally contact the contact rod. The frictional contact generates excess electrical charge accumulation on the band, with the electrical, or at least some of the electrical charge, discharging from the band after the band releases from or disengages with the contact rod.

An electron target is outside the band, proximate a position where the band releases from the contact rod (although in some embodiments the electron target may be within the band). The electron target may be, for example, a metal or metal alloy, or as discussed elsewhere herein. In operation, electrical charge, for example electrons, discharged from the band may strike the electron target, generating x-rays.

Figure 3:
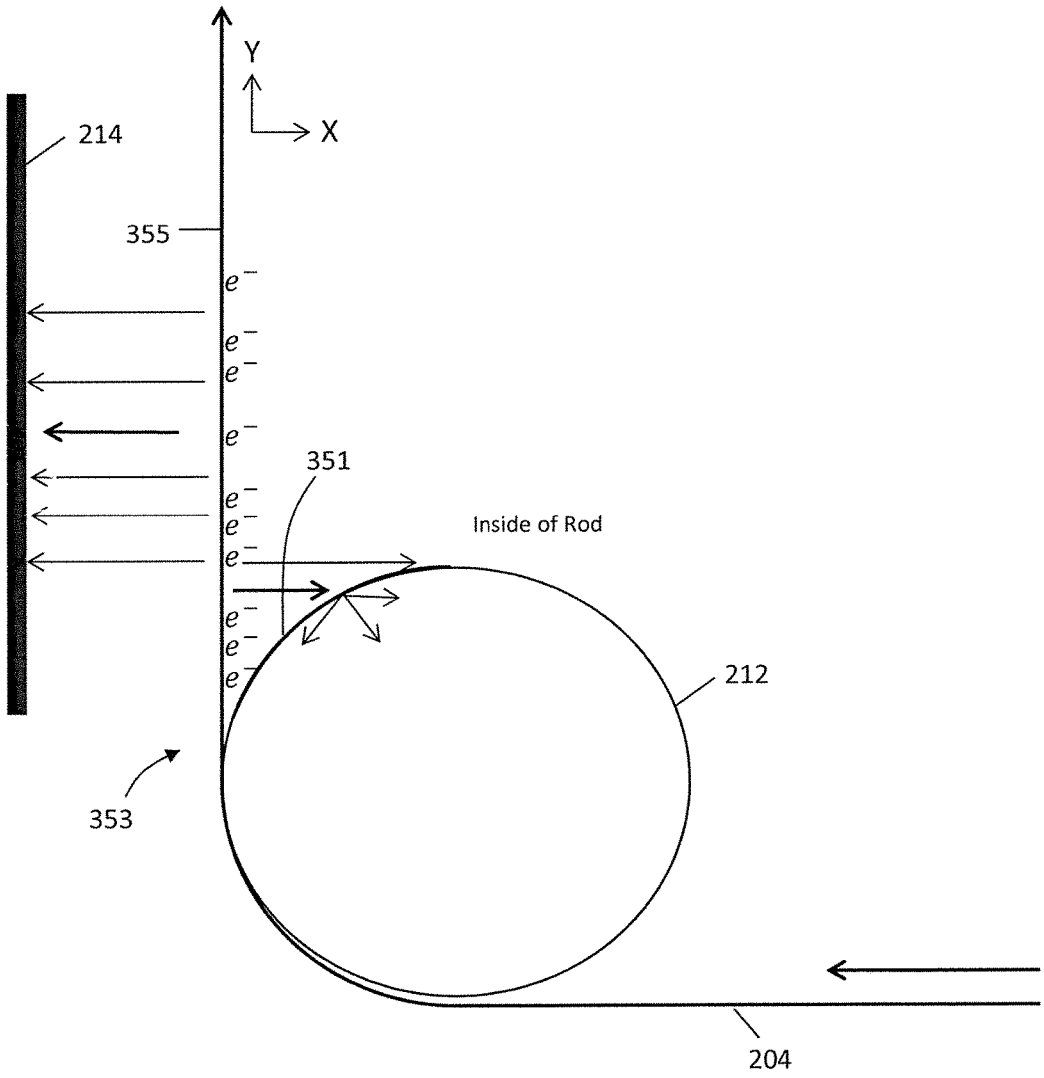
FIG. 3 illustrates a close-up cross-sectional view showing portions of a contact rod, band, and electron target of the high energy radiation generator device of FIG. 2.

FIG. 3 illustrates a close-up cross-sectional view showing portions of the contact rod 212, band 204, and electron target 214 of the high energy radiation generator device of FIG. 2. As discussed with respect to FIG. 2, electrical charge accumulates on the band due to frictional contact with the contact rod, with some of the electrical charge releasing from portions of the band as those portions of the band move past a release point 353 at which the band loses contact with the contract rod.

In various embodiments the band and/or the contact rod are configured to provide additional control of x-ray emissions, for example from the electron target.

In some embodiments an outer surface 355 of the band, which faces the electron target, at least soon after release from the contact rod, includes a structure or is modified so as to enhance field emission to the electron target.

In some embodiments the outer surface, or back, of the band includes a surface texture to enhance field emissions. In some embodiments the surface texture is provided through removal of some material of the band, for example by way of etching or abrading. In some embodiments the surface texture is provided by way of selectively adding material to the outer surface of the band, for example by way of deposition or selective deposition. In some embodiments the surface texture is provide by way of both depositing material on the band and etching of the band. In some embodiments a material with a textured surface is attached to the outer surface of the band. In some embodiments the back of the band includes a polyimide glue, for example a Kapton glue. In some embodiments the back of the band includes metal particles in a polyimide, for example Kapton, matrix. In some embodiments the back of the band includes carbon nanotubes, which in some embodiments may be multi-walled carbon nanotubes (MWNT), which in some embodiments may be embedded in a polyimide, for example Kapton, matrix.

In some embodiments a surface of the contact rod includes a material or is coated with a material to assist in control of x-ray emissions. In some embodiments the surface of the contact rod which includes the material or has the coating is only a portion of the surface proximate to the release point of the band, and in some embodiments is only such a portion which does not contact the band.

In some embodiments the portion of the surface of the contact rod is of, or coated with, a low Z material, with Z referring to a number of protons or electrons of the material. In some embodiments the material is a conductive carbon paint. In some embodiments the material is an insulating polyimide, for example Kapton, glue.

In some embodiments the portion of the surface of the contact rod is of, or coated with, a material expected to provide a spectrum of x-rays with a same spectrum as that expected to be provided by the electron target. In some embodiments the portion of the surface of the contact rod is, or is coated with, a material as that of the electron target.

Figure 4:
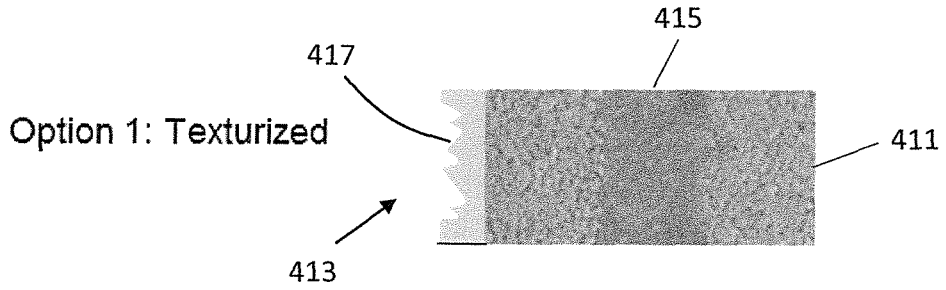
FIG. 4 illustrates a cross-sectional view of a portion of a first band for a high energy radiation generator device, in accordance with aspects of the invention.

FIG. 4 illustrates a cross-sectional view of a portion of a first band for a high energy radiation generator device, in accordance with aspects of the invention. The portion of the band may be a portion of the band of FIGS. 1-3. The band includes an inner surface 411 and an outer surface 417, with a bulk of material 415 between the inner surface and the outer surface. The inner surface is for contacting a contact material, for example a contact rod, and the outer surface 417, may periodically faces an electron target, for example upon or after releasing from the contact rod.

The outer surface of the band of FIG. 4 includes a texturized surface. In some embodiments the texturized surface provides a plurality of tips. In some embodiments the texturized surface includes a plurality of surface discontinuities. In some embodiments the texturized surface is provided by selectively depositing material on the outer surface of the band. In some embodiments the texturized surface is provided by depositing material on the outer surface of the band and selectively etching, or abrading, the deposited material.

Figure 5:
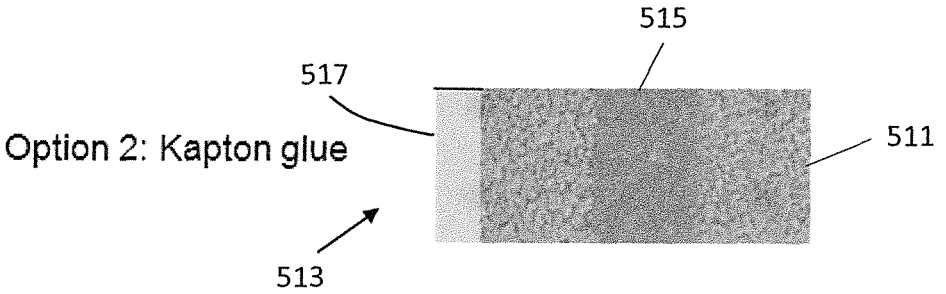
FIG. 5 illustrates a cross-sectional view of a portion of a second band for a high energy radiation generator device, in accordance with aspects of the invention.

FIG. 5 illustrates a cross-sectional view of a portion of a second band for a high energy radiation generator device, in accordance with aspects of the invention. The portion of the band may be a portion of the band of FIGS. 1-3. The band includes an inner surface 511 and an outer surface 517, with a bulk of material 515 between the inner surface and the outer surface. The inner surface is for contacting a contact material, for example a contact rod, and the outer surface, may periodically faces an electron target, for example upon or after releasing from the contact rod.

The outer surface of the band of FIG. 5 includes a polyimide glue, for example a Kapton glue.

Figure 6:
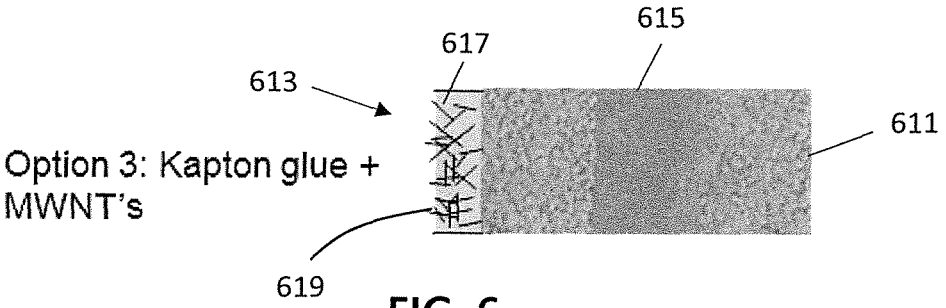
FIG. 6 illustrates a cross-sectional view of a portion of a third band for a high energy radiation generator device, in accordance with aspects of the invention.

FIG. 6 illustrates a cross-sectional view of a portion of a third band for a high energy radiation generator device, in accordance with aspects of the invention. The portion of the band may be a portion of the band of FIGS. 1-3. The band includes an inner surface 611 and an outer surface 617, with a bulk of material 615 between the inner surface and the outer surface. The inner surface is for contacting a contact material, for example a contact rod, and the outer surface, may periodically faces an electron target, for example upon or after releasing from the contact rod.

The outer surface of the band of FIG. 6 includes a polyimide glue, for example a Kapton glue, with multi-walled carbon nanotubes (MWNTs) embedded in the glue.

Figure 7:
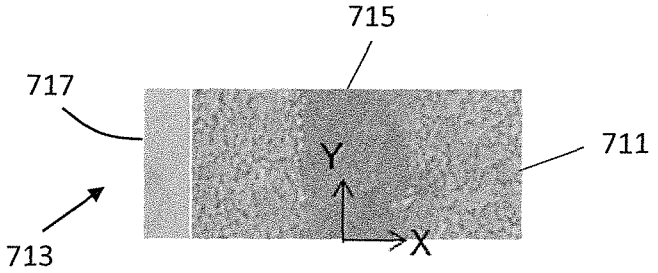
FIG. 7 illustrates a cross-sectional view of a portion of a fourth band for a high energy radiation generator device, in accordance with aspects of the invention.

FIG. 7 illustrates a cross-sectional view of a portion of a third band for a high energy radiation generator device, in accordance with aspects of the invention. The portion of the band may be a portion of the band of FIGS. 1-3. The band includes an inner surface 711 and an outer surface 717, with a bulk of material 715 between the inner surface and the outer surface. The inner surface is for contacting a contact material, for example a contact rod, and the outer surface, may periodically faces an electron target, for example upon or after releasing from the contact rod.

The outer surface of the band of FIG. 7 includes a polyimide glue, for example a Kapton glue, with metal particles (not visible in FIG. 7) embedded in the glue.

Although the invention has been discussed with respect to various embodiments, it should be recognized that the invention comprises the novel and non-obvious claims supported by this disclosure.

What is claimed is:

1. An x-ray generation device, comprising:

a housing for maintaining a low fluid pressure environment;

a contact material within the housing;

a band including an inner surface and an outer surface, the inner surface in frictional contact with the contact material; and an electron target proximate a location of frictional contact between the band and the contact material, the electron target outside an area defined by the band;

wherein the outer surface of the band includes a textured surface including a plurality of surface discontinuities.

2. The x-ray generation device of claim 1, wherein the contact material includes a portion of a surface comprising a low Z material.

3. The x-ray generation device of claim 1, wherein the electron target comprises an electrically conductive material.

4. The x-ray generation device of claim 1, wherein the electron target comprises a low Z material with a coating of an electrically conductive material.

5. The x-ray generation device of claim 1, further comprising a tensioner and a drive roller, with the band looped around the tensioner and the drive roller.

6. The x-ray generation device of claim 5, wherein the tensioner is configured to apply a tension between 0.1 Newtons and 20 Newtons to the band.

7. The x-ray generation device of claim 5, wherein the drive roller is operable at a speed between 100 revolutions per minute and 20000 revolutions per minute.

8. The x-ray generation device of claim 1, wherein the contact material comprises a contact rod.

9. An x-ray generation device, comprising:

a housing for maintaining a low fluid pressure environment;

a contact material within the housing;

a band including an inner surface and an outer surface, the inner surface in frictional contact with the contact material; and an electron target proximate a location of frictional contact between the band and the contact material, the electron target outside an area defined by the band;

wherein the outer surface of the band includes a textured surface, wherein the textured surface comprises carbon nanotubes.

10. The x-ray generation device of claim 5, wherein the carbon nanotubes are embedded in a polyimide matrix.

11. The x-ray generation device of claim 5, wherein the carbon nanotubes comprise multi-walled carbon nanotubes.

* * * * *